United States Patent [19]

Aho

[11] 4,176,747

[45] Dec. 4, 1979

[54] STACKABLE CRATES

[75] Inventor: Leo E. Aho, Tampere, Finland

[73] Assignee: Sarvis Oy, Tampere, Finland

[21] Appl. No.: 886,778

[22] Filed: Mar. 15, 1978

Related U.S. Application Data

[63] Continuation of Ser. No. 727,846, Sep. 29, 1976, abandoned.

[51] Int. Cl.[2] ..... B65D 21/02

[52] U.S. Cl. ..... 206/509; 220/23.83; 220/72; 220/DIG. 15

[58] Field of Search ..... 16/171; 220/21, DIG. 15, 220/337, 338, 23.83, 72, 91; 206/503, 509, 511, 512; 214/10.5

[56] References Cited

U.S. PATENT DOCUMENTS

| | | | |
|---|---|---|---|
| 2,575,919 | 11/1951 | Kautzmann | 206/511 X |
| 2,738,564 | 3/1956 | Guinane | 214/10.5 R X |
| 2,765,949 | 10/1956 | Hillman | 220/338 |
| 2,916,161 | 12/1959 | Schaefer | 206/512 X |
| 3,002,650 | 10/1961 | Lovell | 220/72 X |
| 3,378,161 | 4/1968 | Lookabaugh | 206/509 X |
| 3,651,992 | 3/1972 | Hazard | 220/338 X |
| 3,653,734 | 4/1972 | Ungaro | 206/509 X |
| 3,762,594 | 10/1973 | Utz | 220/21 |
| 3,841,519 | 10/1974 | Stromberg | 220/21 X |
| 3,984,028 | 10/1976 | Zinnbauer | 220/338 |
| 3,997,055 | 12/1976 | Box | 220/509 X |

FOREIGN PATENT DOCUMENTS

| | | | |
|---|---|---|---|
| 2202653 | 7/1973 | Fed. Rep. of Germany | 206/503 |
| 709473 | 6/1966 | Italy | 220/21 |
| 481797 | 1/1970 | Switzerland | 220/21 |
| 826578 | 1/1960 | United Kingdom | 206/512 |

*Primary Examiner*—Allan N. Shoap

[57] ABSTRACT

Plastic stackable crates for transportation and storage of goods, e.g. packages containing fluids and the like, and particularly for milk carton containers, comprising main and bottom portions, the former with front, rear and side walls that are open to the bottom, while the bottom portion is of the grating type, detachable and pivotable, allowing to be turned upwards and left in the upturned position so that the goods can be taken out through the tops of the empty upper crates when several of them are stacked up. Apertures on the front and/or rear walls of the crates, when stacked up, make a combined, almost full-height aperture which also allows the goods to be taken out sideways from the stacked crates.

7 Claims, 10 Drawing Figures

STACKABLE CRATES

This application is a continuation of Ser. No. 727,846, filed Sept. 29, 1976, now abandoned.

The invention relates to cases or crates, stackable one above another, intended particularly for the transportation and storage of milk carton containers and similar products at sales points.

Plastic stackable crates as such, made in one piece, have been known for a long period. With these, however, there exists the inconvenience that it is difficult and often quite impossible to take out goods from such crates when they are beneath other stacked-up crates. The stack is to be unloaded for this purpose, which is of course inconvenient.

Crates are known, however, for instance those for soft drinks, the side walls of which have sufficiently large apertures through which bottles can be taken out from the crates even if the crate in question is one of the lowest in the stack. Such a wall aperture of a soft-drink crate is usually provided with a transversal rib block which can be lifted while bottles are removed. During transportation the rib prevents the bottles from falling out.

Crates for soft drinks or any other crates of the mentioned type are, however, not suitable for the transportation or storing of milk carton containers due to the fact that such containers cannot be taken out easily through the side apertures, when the crates are stacked up, e.g. in a cooled area in a milk shop, where stacked one above another, so that the side apertures of the crates may face the take-out orifices of the cooled area.

The removal of the milk containers, especially from the lowest stacked-up crates, is difficult since the service opening cannot reach to the bottom. In case apertures were made so high that the containers could be removed easily, superfluous empty spaces would remain in the upper parts of the crates, which in turn would not be economical in regards to the utilization of the space and the costs of such crates.

The object of this invention is to eliminate the described drawbacks and to create such transportation and storable crates for milk carton containers from which the packages or containers can be taken out easily, while the crates are stacked up in a cooler, so that the crates are accessible at the buyers' side of the shop.

According to major features of the invention, plastic stackable crates are provided for transportation and storage of goods, which comprise main and bottom portions, the former with front, rear and side walls that are open to the bottom, while the bottom portion is of the grating type, detachable and pivotable, allowing to be turned upwards and left in the upturned position so that the goods can be taken out through the tops of the empty upper crates when several of them are stacked up.

According to an important feature, apertures on the front and/or rear walls of the crates, when stacked up, make a combined, almost full-height aperture which also allows the goods to be taken out sideways from the stacked crates.

Other optional, suggested features and details will be described hereunder.

A preferred, exemplary embodiment according to the invention is described in detail in the following specification, referring to the accompanying drawings, wherein:

FIG. 1 shows a stackable crate according to the invention in a front elevation;

FIG. 2 presents the crate in a top view;

Figure 1:
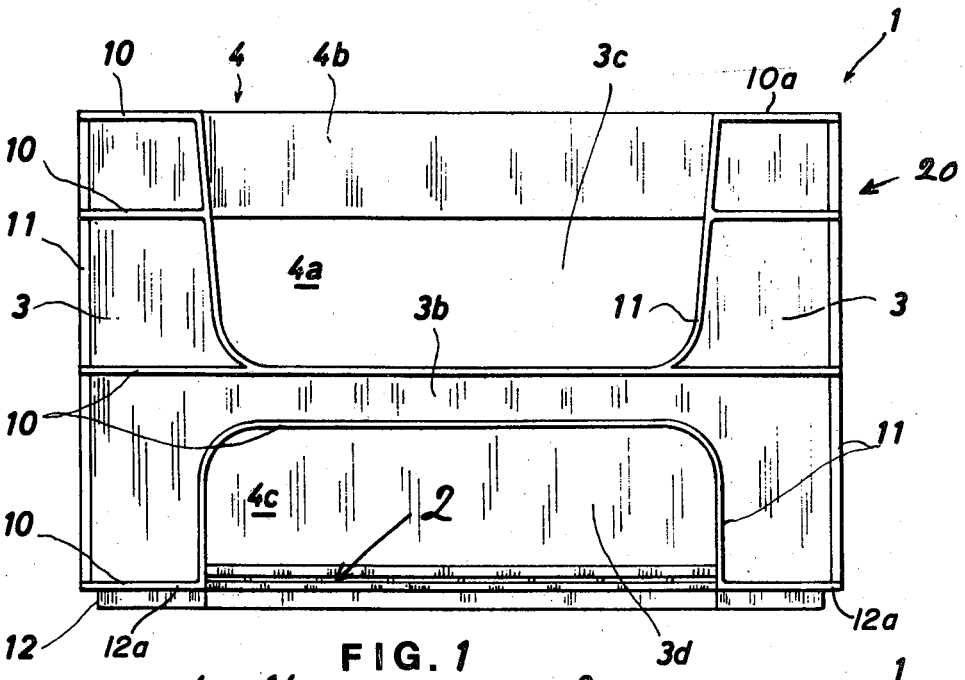
Figure 2:
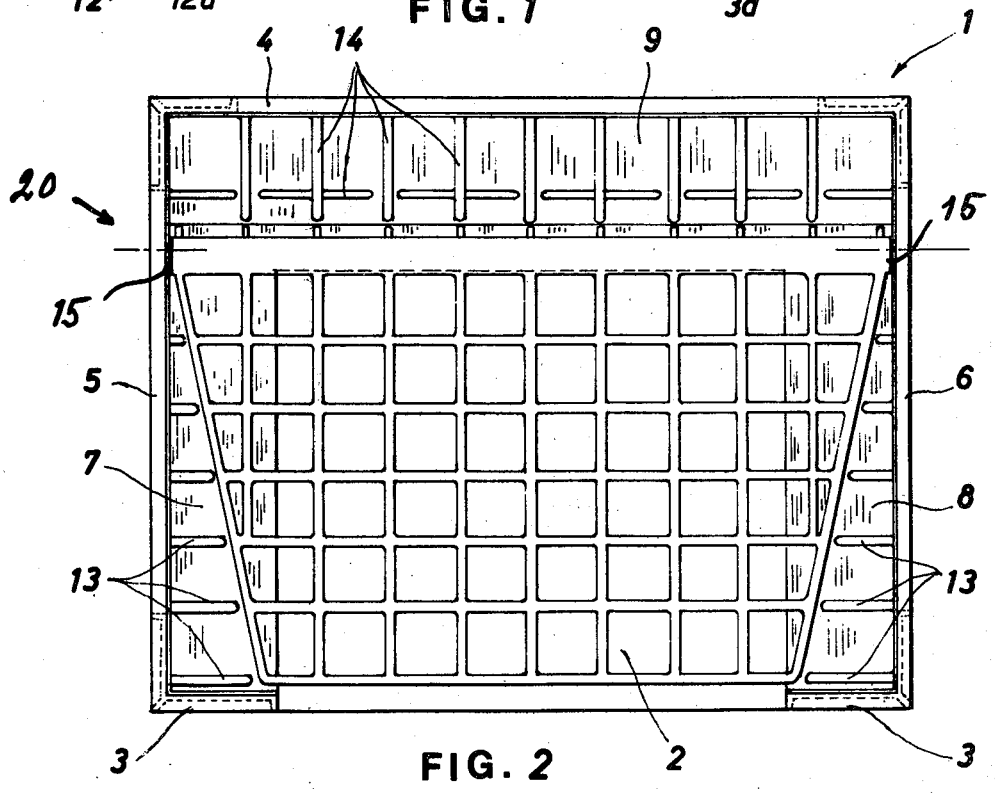
Figure 3:
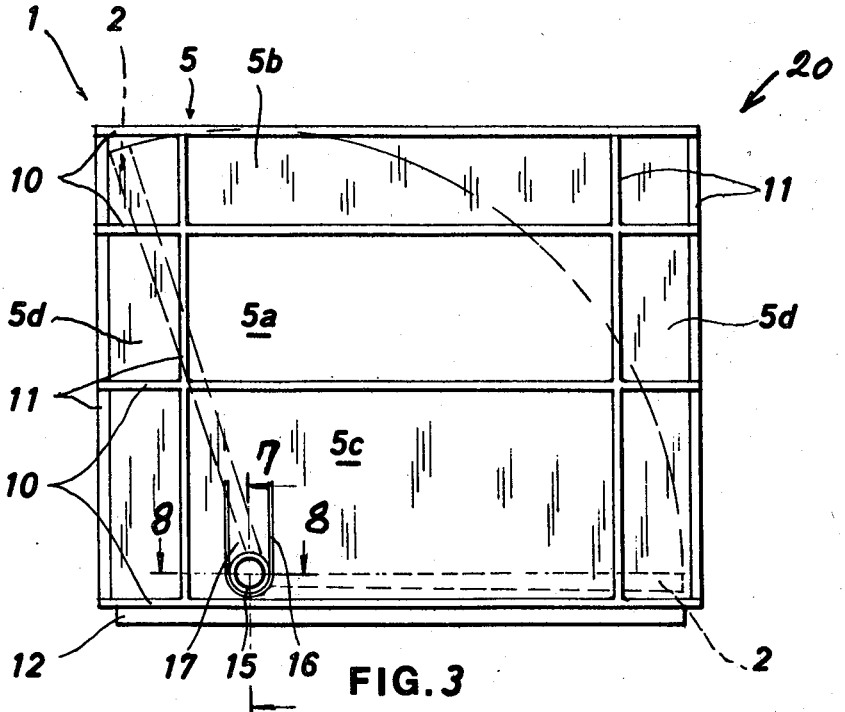
FIG. 3 shows the crate in a side view.
Figure 5:
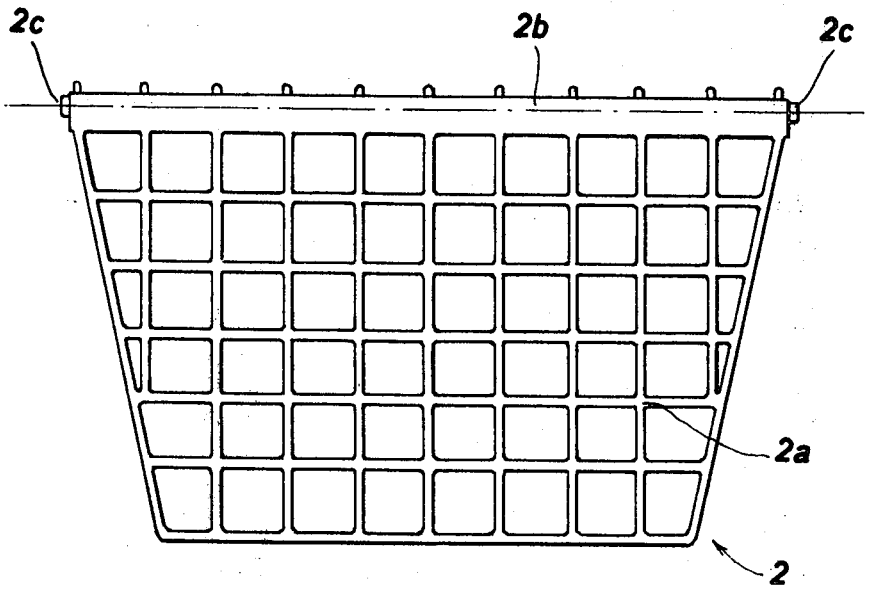
FIG. 5 is the bottom grating by itself in a top view.
Figure 6:
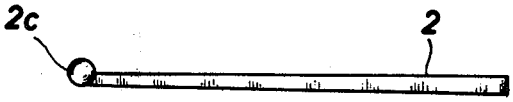
Figure 7:
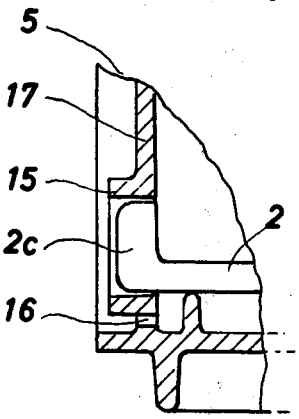
Figure 8:
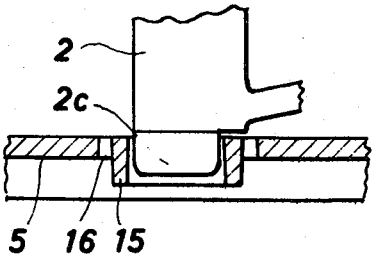
Figure 9:
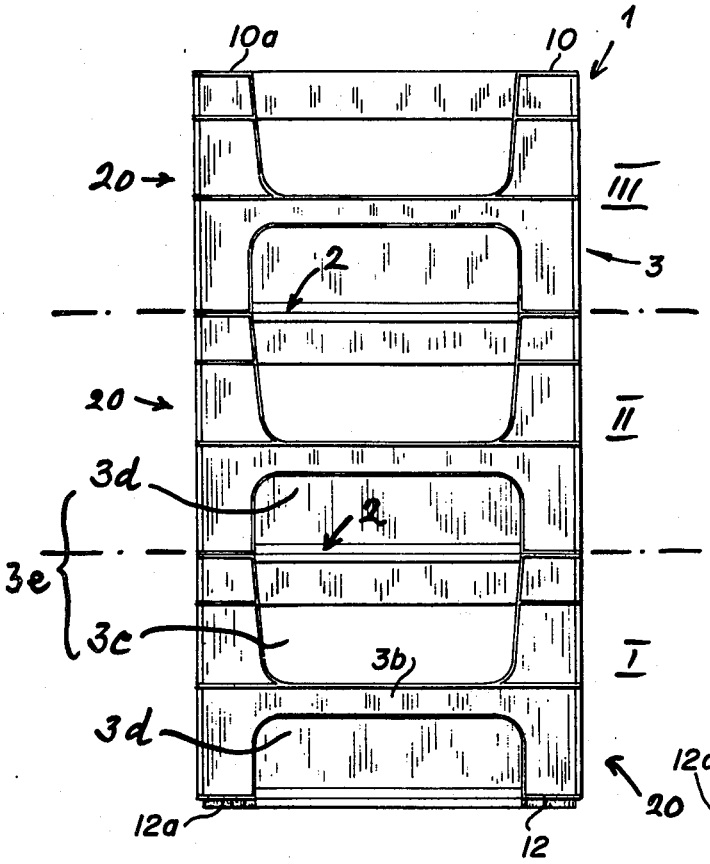
Figure 10:
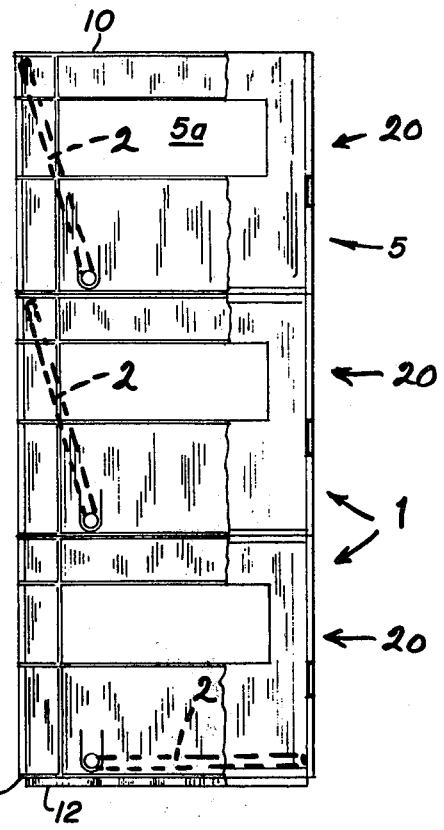

FIG. 6 presents the bottom grating in a side view taken from the left-hand side of FIG. 5;

FIG. 7 is a cross-section along line 7—7 of FIG. 3, at a hinge joint for the bottom grating of FIGS. 5, 6;

FIG. 8 is a cross-section along line 8—8 of FIG. 3, perpendicular to FIG. 7;

FIG. 9 shows three crates according to FIGS. 1 to 3, stacked up one above another, in a front view; and FIG. 10 is a similar stacked-up view of the crates of FIG. 9 in a side illustration.

Figure 4:
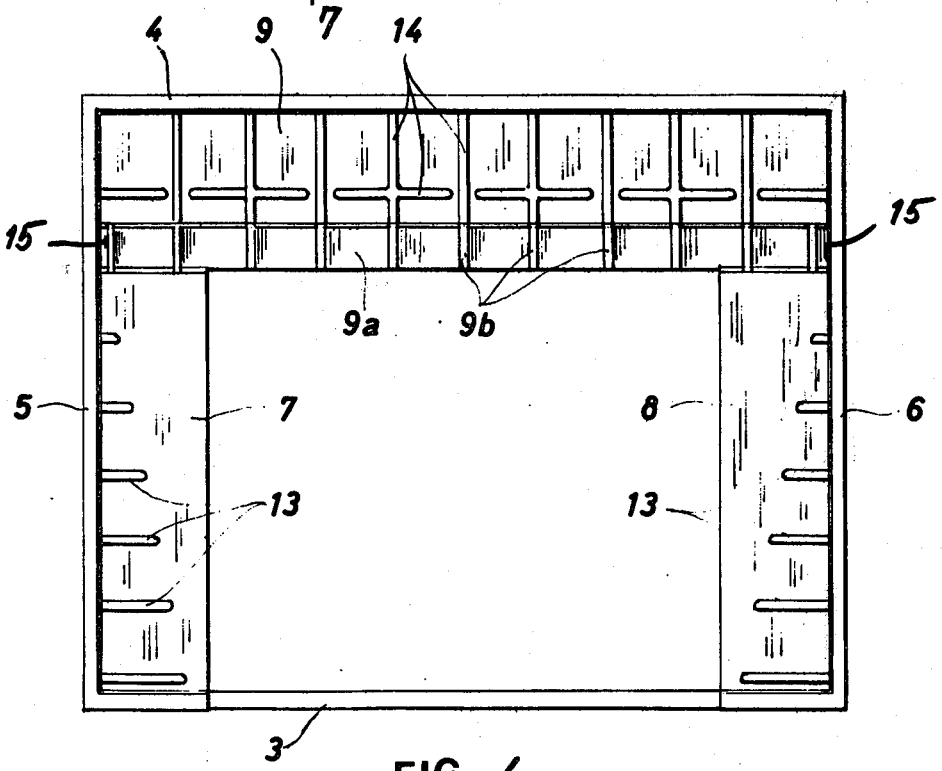
FIG. 4 shows the crate in a top view, similar to FIG. 2, but without a bottom grating being inserted.

The exemplary stackable crate according to the invention is generally designated in FIGS. 1 through 3, 9 and 10 with numeral 20, and has two separately manufactured main parts: a case proper 1 and a detachable bottom grating construction 2 (FIGS. 4 and 5 for the latter), both being preferably made of sturdy, solid plastic material.

The crate comprises front and rear walls 3, 4, side walls 5, 6, as well as two separate bottom border parts that support the bottom grating 2, side borders 7, 8 and a rear border 9. As will be understood from the description that follows (but not specifically apparent from the drawings) the bottom of the inventive crate 20 is entirely open (except when the bottom portion 2 is inserted in the case 1 in a planar condition). As can be seen from a comparison of FIGS. 1 and 3, as well as 9 and 10, respectively, the front 3 (and rear 4) walls are longer than the side walls 5 (6).

According to a main characteristic feature of the invention, the front wall 3 (and/or the rear wall 4) is broken out in a way so that the relatively narrow side borders 7, 8 of the front wall 3 are united by a rather narrow strip **3*b*, located somewhat underneath the horizontal center of the wall height. Thus wide apertures 3*c*, 3*d* remain above and below this strip 3*b* in the walls, the upper and lower borders of the same being fully open (FIG. 1). The purpose of these apertures is to allow taking out goods sideways from the crates 20, especially when the latter are stacked up one above another, as this will be described more particularly with reference to FIGS. 9, 10. It might be mentioned for the sake of completeness that the reference numerals 2*a*, 2*b*, 2*c*** will be described somewhat later.

The case portion 1 is constructed so that relatively thin wall surfaces are supported by bracing and reinforcement, with horizontal and vertical stiffening ribs 10, 11. Braces are likewise inserted into the other wall apertures in order to reduce the use of raw material, in the first place, and to facilitate the handling of the crates.

Thus in the rear wall 4 of the crate there is an aperture **4*a* (FIG. 1) which is restricted by the wall's upper part 4*b* and by a lower part 4*c***, as well as by side parts, connected with these, but which cannot be seen in the illustrations.

Both side walls 5, 6 may also be provided with apertures **5*a*, 6*a*, limited by upper and lower sections 5*b*, 6*b* and 5*c*, 6*c* of the walls, as well as by side borders 5*d*, 6*d* (FIG. 3, the elements 6*a* . . . 6*d*** not being visible).

The side and rear walls 5, 6, 4 of the crate 20 are made with the horizontal bracing ribs 10 at the upper and lower edges and at the level of the wall aperture borders, and with the vertical bracing ribs 11 in corners and at the level of the aperture borders. In the front wall 3 the upper and lower border ribs 10 are formed to envelop the open edges of the apertures *3c, 3d.* Due to tenacity reasons these apertures are made with considerable roundings, as shown.

Lower edge surfaces 12*a* of the crate having spaced inwardly therefrom a control border 12, constituting guiding means for stacking purposes. The control border is so dimensioned that it can lead and fit into a crate below in a stack, being smaller in all directions than top edge surfaces 10*a* of the ribs 10 of the crate (see bottom and top portions of FIGS. 1 and 9), thus facilitating the stacking up of the crates, as will be explained in connection with FIGS. 9, 10.

The border sections 7, 8 and 9, that support the bottom grating 2, are also provided with bracing ribs 13, 14, the height of the same being such that the upper surfaces of the ribs are at the level of the upper surface of the bottom grating portion 2 when the latter is properly inserted in a planar condition (seen at the bottom of FIG. 1, in all crates 20 of FIG. 9, and only in the lowermost crate of FIG. 10).

The grating portion 2 (see FIGS. 2 and 5), when looked at from above, may narrow from the rear 4 towards the front wall 3 in order to be easily removed or replaced. The length of the ribs 13 in the border sections 7, 8 follow this form (FIG. 2). A front section 9*a* of the rear border 9 in the bottom cross-section may be molded slightly concave to correspond to the expanded form of the rear border 9. This concave section 9*a* also braces the bottom part 2. The section 9*a* is preferably also provided with transversally running ribs 9*b* that brace the grating borders.

According to the invention the bottom grating portion 2 can be hinged (FIG. 3) between the concave bottom section 9*a* and the side walls 5, 6, as will explained. Due to the pivotable, hinged bottom grating 2 it is possible to take out goods, e.g. milk packages, even from the lowest stacked-up crate 20, after the upper ones are empty, without need to remove any empty crate from the top. In addition to a grating proper 2*a*, the bottom portion 2 is furnished with a solid border 2*b*, preferably at the rear of the case portion 1, at both ends of which there are short fulcrums 2*c* that fit into bearings 15 with holes in the side walls 5, 6 (FIGS. 3, 7 and 8). At least one of these attachment holes 15 is made to be such that it also reaches a flexible tongue 17 which is partly separated from the respective side wall by a slit 16 (see FIG. 3) so that the grating 2 can be easily detached from the case portion 1 proper or replaced by relying on the flexibity of the connection at the bearing points 15.

Further according to the invention, the hinges of the grating 2 are placed sufficiently forward in regards to the rear wall 4 so that the grating can easily remain in the upturned position, leaning against the rear wall 4. This is clearly shown in FIG. 3 where both the upturned as well as the folded-down, planar positions of the bottom portion 2 are shown in broken lines, similar alternative illustrations appearing in the upper and lowermost crates 20 of FIG. 10. It will be understood of course that in each crate the grating portion 2 has to be inserted and folded down to be substantially horizontal before loading the goods thereinto, and they are pivotable and then turned up only when empty in the upper areas of a stack of the crates, to allow access to the lower, still loaded crates.

In FIG. 9, three crates 20 are shown, superposed or stacked, the lowermost one being identified by numeral I, the next higher one with II, and the topmost (in this example) with III, the horizontal partition lines, at the levels of the respective nested pairs of border ribs 10 and control borders 12, being shown in dot-dash lines. FIG. 10 shows a similar stack. In FIG. 9 the apertures *3c, 3d* of adjoining crates are identified, together constituting a novel combined aperture 3*e* for the easy sideways removal of the goods from either of the two superposed crates. As a matter of example, all bottom grating portions 2 are shown in FIG. 9 folded down, while in FIG. 10 only the bottom one is down and the two upper ones are turned up to allow access to the lowermost crate 20 from above.

The advantageous technical effect is clearly indicated in these illustrations, where the apertures *3c, 3d* in the respective front walls 3 of adjoining, superposed crates 20 form the combined aperture 3*e*, having a height nearly corresponding to that of any one of the crates. When the bottom grating 2 of the top (or subsequent lower) crate or crates is pivoted upwards, the goods, e.g. milk packages, can be taken out from above, through the open crates, from any still loaded crate below. The invention thus provides double access, namely from the sides, through the combined apertures 3*e*, and also from the top of the topmost crates, when the bottom portions 2 are folded up.

Advantageous use of the invention can be carried out particularly in connection with shop rationalization, when e.g. such arrangements are realized that the milk packages, i.e. carton containers, are delivered from dairies or milk distributors, readily inserted into crates according to the invention. Three or four crates can be stacked up, and probably two such stacks provided in each unit of transportation, e.g. on a wheeled transportation pallet or rack.

In such a case the unit is pushed directly into the cooled milk storage area in the shop so that the front walls of the crates or piles are placed near the wall opening of the sale space so that the buyers can easily help themselves to the required products. It is not necessary any more to transfer these crates anywhere before they are completely empty. Consequently time-consuming intermittent manipulation of the semi-filled and empty crates is completely dispensed with. Then the entire stack of empty crates can be removed from the rack in a single operation and replaced by full ones, which is done by simply pushing them in.

Consequently, when using the crates according to the invention, handling and transportation costs can be reduced considerably.

The invention can be obviously used also for other kinds of goods and purposes than for the transportation and sales of milk packages, given only by way of an example.

The utilization of the inventive crates can be carried out also by different ways than presented hereinabove.

It will be understood by those skilled in the art that various modifications in, or additions to, the described preferred, exemplary crate embodiment according to the invention can be made without departing from the spirit and scope of the invention.

What I claim is:

1. A stackable plastic crate (20) for transportation and storage of goods, e.g. containers for fluids and the like, and particularly for milk carton containers, comprising, in combination: a main case (1) constituted by front (3), rear (4) and two side (5, 6) walls, said side walls being shorter than said front and said rear walls; a single detachable, pivotable bottom (2) of the grating (2*a*) type in said main case, which latter has an open top; said side walls having therein a pair of hinges (2*c*) for pivoting said bottom within said main case between a lowered, substantially horizontal closed position and a partly upwardly open position; a peripheral bottom border (12) below said walls and inwardly spaced from bottom edge sufaces (12*a*) of said walls; transversal (9*b*) and peripheral (10, 11) bracing and reinforcing ribs, the latter including a top border (10) above said side walls and said front and said rear walls and defining top edge surfaces (10*a*) thereof, said top border being somewhat wider than said bottom border so that said borders constitute stacking means cooperating with such borders of adjoining identical crates when the crate is made to form part of a vertically superposed stack (I, II, III . . . ); at least one of said front and rear walls having therein a pair of axially spaced, substantially rectangular apertures, the upper aperture having a U-shape and being bounded by a bottom edge and two spaced side edges, the spacing of the two side edges defining a discontinuity of the top border and the top edge surfaces, the lower aperture having an inverted U-shape and being bounded by a top edge and two spaced side edges, the spacing of the side edges of the lower aperture defining a discontinuity of the bottom border and the bottom edge surfaces; a narrow transverse wall section (3*b*) between said apertures in said one wall spacing said apertures apart and located about halfway the overall height of said main case; said apertures and said stacking means defining mating means for forming a peripherally enclosed and substantially rectangular access opening between two of the adjoining identical crates when the crate forms part of the stack, said upper aperture of a lower crate (I) and said lower aperture of an upper crate (II) from the two crates in the stack constituting together a contiguous, combined aperture (3*e*) defining said access opening, the opening the total height of which nearly corresponds to that of said main case; whereby goods are removable from the stack of crates laterally through said combined aperture when said bottom of a crate immediately above a combined aperture is in its open position.

2. The crate as defined in claim 1, wherein said bottom (2) narrows from said one of the front (3) and rear (4) walls toward the other of these walls, the edge of said bottom, that faces said other wall, having substantially the same length as the bottom of said lower aperture (3*d*).

3. The crate as defined in claim 1, wherein said hinges (2*c*) are at points (15) on said side walls (5, 6) far enough from said rear wall (4) so that said bottom (2) remains in its open position to allow access to the goods when it is other than the topmost crate in the stack.

4. The crate as defined in claim 3, wherein said hinge points (15) are provided on flexible tongues (17) that are molded from said side walls (5, 6).

5. The crate as defined in claim 4, wherein said tongues (17) are partly separated from said side walls (5, 6) by slits (16).

6. The crate as defined in claim 1, wherein said main case (1) is reinforced by at least two lateral bottom border sections (7, 8) angularly connected to said side walls (5, 6) and by a rear bottom border section (9) angularly connected to said rear wall (4), said border sections being substantially at the level of said pivotable bottom (2) in its closed position.

7. The crate as defined in claim 6, wherein said border sections (7, 8, 9) are provided on their upper surfaces with protruding ribs (13, 14), the height of which is such that the upper edges of said ribs are at the level of the upper surface of said bottom (2) in its closed position.

* * * * *